US006193463B1

(12) United States Patent
Adeff et al.

(10) Patent No.: US 6,193,463 B1
(45) Date of Patent: Feb. 27, 2001

(54) DIE CAST COMPRESSOR HOUSING FOR CENTRIFUGAL COMPRESSORS WITH A TRUE VOLUTE SHAPE

(75) Inventors: George A. Adeff, Los Angeles, CA (US); Christopher S. Marr, West Linn, OR (US)

(73) Assignees: AlliedSignal, Inc., Morristown, NJ (US); Consolidated Metco, Inc., Clackamas, OR (US)

( * ) Notice: Subject to any disclaimer, the term of this patent is extended or adjusted under 35 U.S.C. 154(b) by 0 days.

(21) Appl. No.: 09/343,734

(22) Filed: Jun. 30, 1999

(51) Int. Cl.[7] ..... F04D 29/44
(52) U.S. Cl. ..... 415/196; 415/206
(58) Field of Search ..... 415/196, 197, 415/214.1, 206, 204, 212.1, 172.1, 203, DIG. 915, 170.1; 417/407, 83

(56) References Cited

U.S. PATENT DOCUMENTS 3,574,478 * 4/1971 Toth, Jr. et al. ..... 415/112

5,246,352 * 9/1993 Kawakami ..... 417/407

* cited by examiner

*Primary Examiner*—F. Daniel Lopez
*Assistant Examiner*—James M McAleenan
(74) *Attorney, Agent, or Firm*—Felix L. Fischer

(57) ABSTRACT

A die cast compressor housing includes an outer shell having a partial outer circumferencial volute wall portion and a projection surrounding the circumference of an aperture in the shell that mates with an insert having a first portion with a substantially cylindrical outer wall that is received in the aperture in the outer shell and includes an air inlet. The insert has a second portion extending radially outwardly and including a mating projection for engagement with the outer shell projection to form an inner circumferencial volute wall portion. A backplate has a third projection adjacent its outer circumference that is received in a relief in the outer shell and completes the outer circumferncial volute wall portion. The outer shell projection has a first land engaging a second land on the mating projection, the first and second lands spirally descending relative to a datum and the relief has a third land in spaced relation to a fourth land on the third projection, the third and fourth lands spirally descending respectively relative to the datum.

4 Claims, 4 Drawing Sheets

DIE CAST COMPRESSOR HOUSING FOR CENTRIFUGAL COMPRESSORS WITH A TRUE VOLUTE SHAPE

BACKGROUND OF THE INVENTION

1. Field of the Invention

The present invention relates generally to cast compressor housings for centrifugal compressors. More particularly, the invention provides a die casting and method for providing a housing having a true volute shape for the compressor outlet.

2. Description of the Related Art

Housings for radial compressors are typically cast aluminum parts which are manufactured using a sand cast or p-mold technique due to the volute shape required in the compressor outlet duct for aerodynamic performance. Previously, the use of die casting was not employed because a true volute shape for the outlet duct could not be achieved, which penalized aerodynamic performance.

Die casting is a very desirable process for volume production due to the inherent dimensional stability and reproducibility for cast parts as well as the material properties achieved by die cast aluminum. Finer tolerances and net shape requirements are more easily obtained with die casting as opposed to alternate techniques. Die casting additionally provides much higher production volume capability compared to the other casting processes. It is, therefore, desirable to provide a die cast compressor housing having a true volute shape in the outlet duct

SUMMARY OF THE INVENTION

The present invention provides a die cast compressor housing that includes an outer shell having a partial outer circumferencial volute wall portion and a projection surrounding the circumference of an aperture in the shell. An insert having a first portion with a substantially cylindrical outer wall is received in the aperture in the outer shell and includes an air inlet. The insert has a second portion extending radially outwardly and including a mating projection for engagement with the outer shell projection to form an inner circumferencial volute wall portion. A backplate has a third projection adjacent its outer circumference that is received in a relief in the outer shell and completes the outer circumferncial volute wall portion. The outer shell projection has a first land engaging a second land on the mating projection, the first and second lands spirally descending relative to a datum and the relief has a third land in spaced relation to a fourth land on the third projection, the third and fourth lands spirally descending relative to the datum.

BRIEF DESCRIPTION OF THE DRAWINGS

The details and features of the present invention will be more clearly understood with respect to the detailed description and drawings in which.

DETAILED DESCRIPTION OF THE INVENTION

Figure 1:
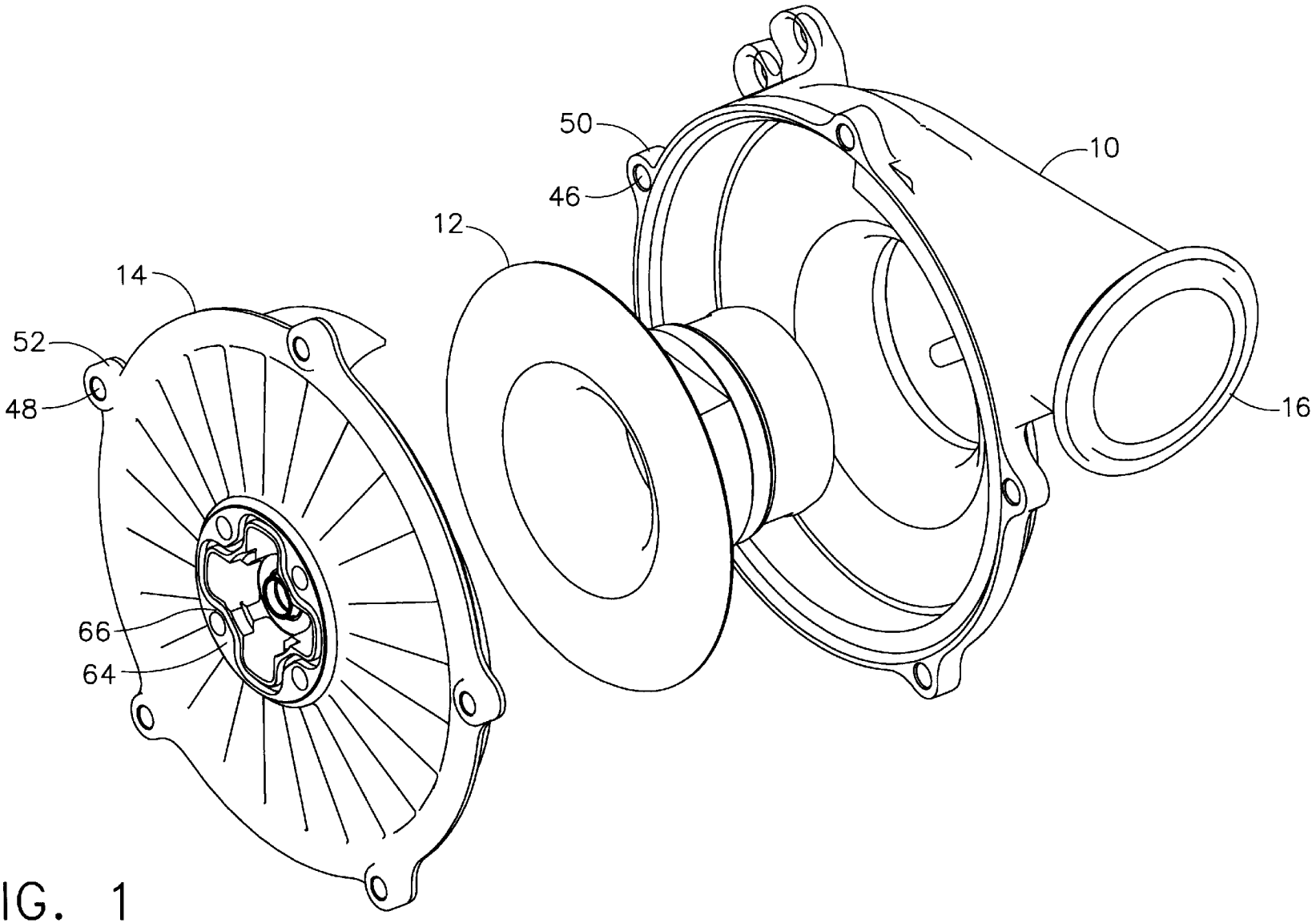
FIG. 1 is an exploded view of the three elements of an embodiment of the present invention.
Figure 2:
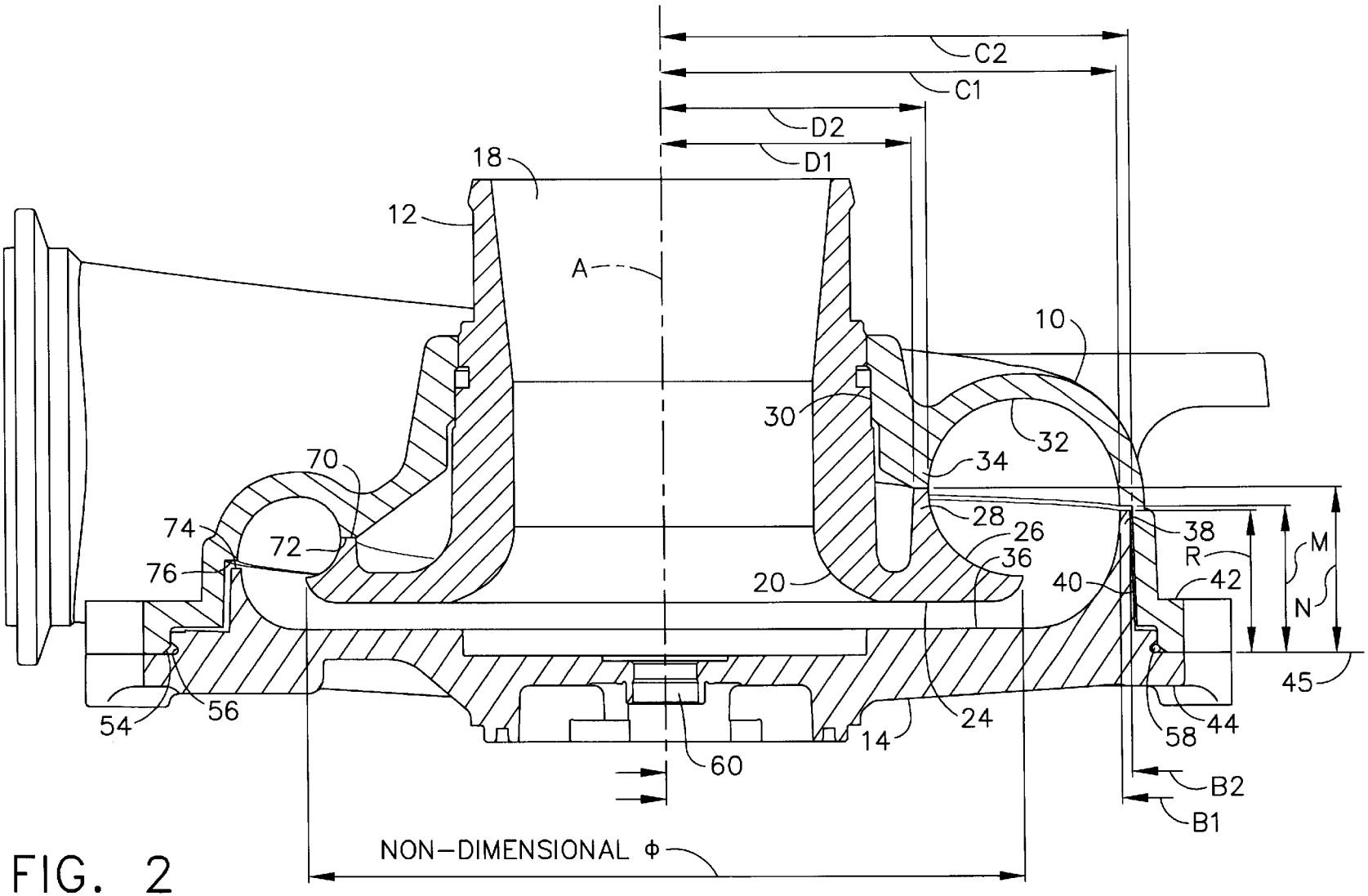
FIG. 2 is a side sectional view of the compressor housing of FIG. 1 in an assembled configuration.

Referring to the drawings, FIG. 1 shows a radial compressor housing incorporating the present invention. The compressor includes a housing outer shell 10, inlet and diffuser wall insert 12 and the backplate 14. The outlet connection 16 from the compressor housing is attached to the engine intake manifold or other device receiving the compressed air. Air for compression enters through an inlet 18, best seen in FIG. 2.

In addition to the air inlet, the insert 12 includes a first portion providing an inducer wall 20 adjacent the compressor impeller (not shown) which rotates around an axis A. A second portion of the insert provides a radially extending surface substantially perpendicular to the axis of rotation of the impeller to form a diffuser outer wall 24. The second portion also forms a volute inner wall portion 26 and extends in a first mating projection 28 for a portion of the inner circumferencial wall of the volute. The first portion of the insert, which has a substantially cylindrical shape with a stepped outer surface is received in a central aperture 30 in the housing outer shell with an interference fit, in the embodiment shown, to retain the insert position relative to the backplate, which will be described in greater detail subsequently. The aperture is concentric with the axis of rotation for alignment of the housing.

The outer shell provides an outer wall 32 for the volute and incorporates a second mating projection 34 adjacent and surrounding the aperture that receives the insert, the second mating projection engaging the first mating projection to form the remainder of the inner circumferencial wall portion of the volute.

Figure 3:
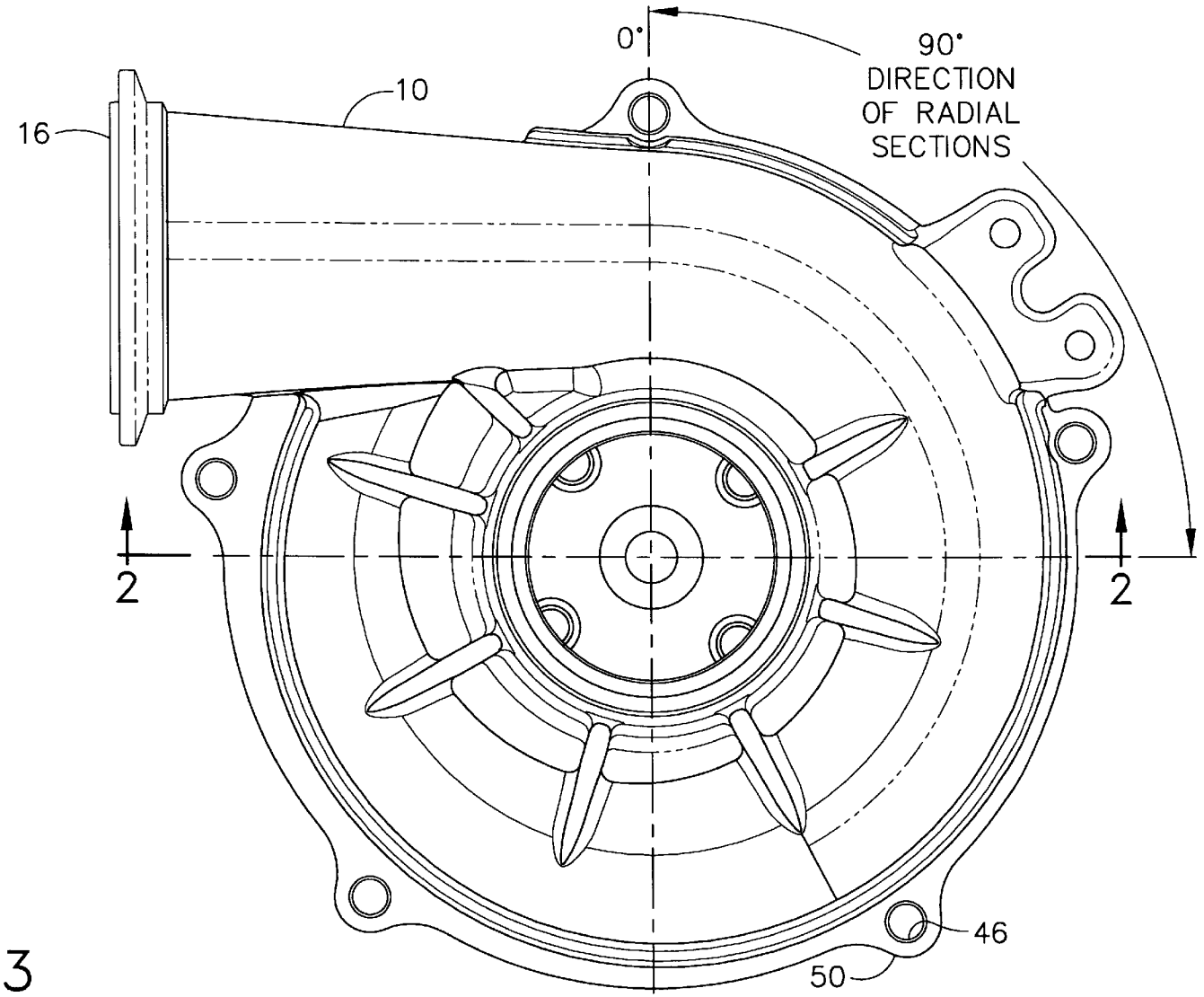
FIG. 3 is an end view of the compressor housing of FIG. 1 in the assembled configuration.

The backplate includes a diffuser inner wall 36 and incorporates a third mating projection 38 that constitutes a portion of the outer circumferencial wall portion of the volute. The third mating projection is received in a relief 40 in the outer shell. For the embodiment shown in the drawings, the peripheral portion 42 of the outer shell engages the peripheral portion 44 of the backplate at a plane defined by numeral 45 and is secured by bolts (not shown) or other attachment means (i.e., v-band clamp, adhesives, etc.) received in mating apertures 46 and 48 of flange tangs 50 and 52 as best seen in FIG. 1 or 3. Returning to FIG. 2, the mating surfaces of the peripheral portions of the outer shell and backplate are machined. The peripheral portion 42 of the outer shell includes a chamfer 54 adjacent a groove 56 in the backplate that engage an o-ring or metallic seal 58. An aperture 60 accommodates a shaft attaching the compressor impeller (not shown) to its motoring device such as a turbocharger turbine or mechanical/electrical drive. For the embodiment shown in the drawings, the backplate includes a sealing land 64 and bolt attachment tangs 66, as best seen in FIG. 1, for attachment of the compressor housing to a turbocharger center housing.

The complete volute is formed by the integrated assembly of the outer shell, insert and backplate. Viewing as exemplary the lower portion of FIG. 2, beginning at the left and moving clockwise, the third projection on the backplate and the outer shell adjacent the relief form the circumferencial outer portion of the volute wall, the outer shell itself forms the outer portion of the wall, the first projection on the outer shell and the mating projection on the insert form the inner circumferencial portion of the wall and, finally, the continuation of the second portion of the insert forms the inner portion of the wall.

Referring again to FIG. 2, the first and second projections terminate in mating lands 70 and 72 which are spirally ascending relative to a datum, which for the embodiment shown is the plane of engagement 45 between the outer shell and backplate. Similarly, the third projection and relief in the outer shell terminate in lands 74 and 76 that are spirally descending relative to the datum. The dimensions of lands 70, 72, 74, and 76 for the first projection 28, second projection 34 and third projections 38 and the relief are as defined by dimensions M, N and R in FIG. 2 which are delineated for the embodiment shown in Table 1. The sector locations for the dimensional references of Table 1 are in 15° increments from a 0° datum shown in FIG. 3. Table 1 also shows the radial dimension of the projections from the axis A with D1 and D2 corresponding to the first projection 28 and second projection 34 while B1 and B2 correspond to the third projection 38. Dimensions C1 and C2 correspond to the radial dimension of the inner circumference of land 76 and the relief 40 in the outer shell. The values in Table 1 have been non-dimensionalized using the diameter of the diffuser identified in FIG. 2 as Φ as the divisor.

Each of the three elements of the compressor housing employing the present invention provides a clear draw for the respective casting die. The spiral ascent and descent of the mating lands on the elements allows a true volute shape to be maintained for maximum aerodynamic performance of the compressor housing. Each element is cast at near net shape and dimension with final machining required only as necessary for sealing on the mating lands 70 and 72, the insert receiving aperture in the outer shell and the mating surfaces of the peripheral portions of the outer shell and backplate. Dimensional relief is provided in the mating lands 74 and 76 which maintain a relational spacing with sufficient tolerance to allow substantially sealing contact of lands 70 and 72. Any leakage from the interface of lands 74 and 76 is contained by seal 58 and the mating surfaces of the peripheral portions of the outer shell and backplate.

Figure 4:
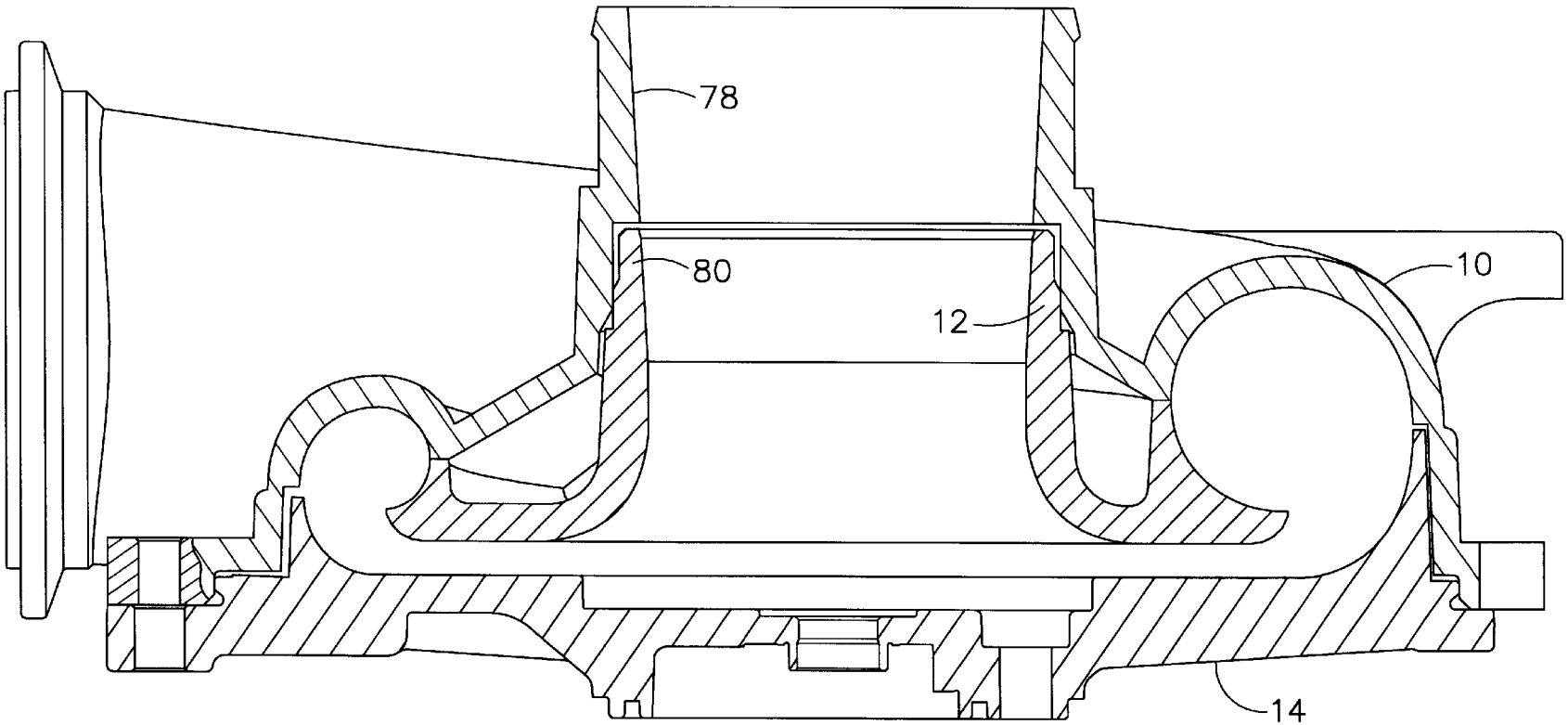
FIG. 4 is a side sectional view of an alternative embodiment of the compressor housing.

FIG. 4 shows an alternative embodiment of the invention which incorporates the compressor inlet 78 as a portion of the outer shell and the diffuser wall insert neck 80 is received within the inlet portion of the outer shell.

Having now described the invention in detail as required by the patent statutes, those skilled in the art will recognize modifications and substitutions to the specific embodiments disclosed herein. Such modifications and substitutions are within the scope and intent of the present invention as defined in the following claims.

TABLE 1

| Section # | 1 | 2 | 3 | 4 | 5 | 6 | 7 |
|---|---|---|---|---|---|---|---|
| Angle | — | 15 | 30 | 45 | 60 | 75 | 90 |
| B1 | — | 5.9035745 | 5.8783902 | 5.8508936 | 5.8325209 | 5.8160229 | 5.7922134 |
| B2 | — | 6.0281839 | 6.0033120 | 5.9760654 | 5.9575053 | 5.9408198 | 5.9173853 |
| C1 | — | 5.9029496 | 5.8775153 | 5.8501437 | 5.8319585 | 5.8155230 | 5.7914635 |
| C2 | — | 6.0888638 | 6.0637420 | 6.0361829 | 6.0177477 | 6.0013123 | 5.9775028 |
| D1 | — | 2.9744406 | 3.0058742 | 3.0382452 | 3.0780527 | 3.1205474 | 3.1606049 |
| D2 | — | 3.1621047 | 3.1934758 | 3.2260342 | 3.2655293 | 3.3080239 | 3.3483939 |
| M | — | 2.0341832 | 2.0258092 | 1.9885014 | 1.9400699 | 1.8935758 | 1.8511436 |
| N | — | 2.3058367 | 2.2487189 | 2.1971003 | 2.1489188 | 2.1019247 | 2.0561804 |
| R | — | 1.9716285 | 1.9635045 | 1.9262592 | 1.8775153 | 1.8310211 | 1.7885889 |

| Section # | 8 | 9 | 10 | 11 | 12 | 13 |
|---|---|---|---|---|---|---|
| Angle | 105 | 120 | 135 | 150 | 165 | 180 |
| B1 | 5.7646544 | 5.7385951 | 5.7164104 | 5.6971003 | 5.6752280 | 5.6481689 |
| B2 | 5.8895763 | 5.8634545 | 5.8413948 | 5.8220847 | 5.8001499 | 5.7732158 |
| C1 | 5.7636545 | 5.7374078 | 5.7152855 | 5.6960379 | 5.6741032 | 5.6467941 |
| C2 | 5.9500062 | 5.9238845 | 5.9016997 | 5.8823897 | 5.8605799 | 5.8334583 |
| D1 | 3.2020997 | 3.2491563 | 3.3033370 | 3.3638295 | 3.4261342 | 3.4893138 |
| D2 | 3.3898262 | 3.4369453 | 3.4913135 | 3.5517435 | 3.6140482 | 3.4896887 |
| M | 1.8088363 | 1.7620922 | 1.7108486 | 1.6571678 | 1.6037370 | 1.5513060 |
| N | 2.0122484 | 1.9701912 | 1.9282589 | 1.8844519 | 1.8373953 | 1.7874015 |
| R | 1.7462192 | 1.6994750 | 1.6482939 | 1.5946131 | 1.5411823 | 1.4887514 |

| Section # | 14 | 15 | 16 | 17 | 18 | 19 |
|---|---|---|---|---|---|---|
| Angle | 195 | 210 | 225 | 240 | 255 | 270 |
| B1 | 5.613798 | 5.575678 | 5.538807 | 5.503812 | 5.459192 | 5.396075 |
| B2 | 5.738845 | 5.700662 | 5.663792 | 5.628421 | 5.584301 | 5.521184 |
| C1 | 5.612173 | 5.573865 | 5.536932 | 5.501937 | 5.457442 | 5.394263 |
| C2 | 5.799150 | 5.761092 | 5.724159 | 5.689163 | 5.644606 | 5.394075 |
| D1 | 3.552555 | 3.616860 | 3.684976 | 3.755093 | 3.826584 | 3.895325 |
| D2 | 3.740532 | 3.805399 | 3.872953 | 3.943069 | 4.014560 | 4.083239 |
| M | 1.499250 | 1.445694 | 1.388326 | 1.325771 | 1.258342 | 1.188038 |
| N | 1.735908 | 1.683789 | 1.630921 | 1.575178 | 1.513685 | 1.442944 |
| R | 1.436695 | 1.383139 | 1.325771 | 1.263154 | 1.195663 | 1.125359 |

| Section # | 20 | 21 | 22 | 23 | 24 | 25 |
|---|---|---|---|---|---|---|
| Angle | 285 | 300 | 315 | 330 | 345 | 360 |
| B1 | 5.319147 | 5.239470 | — | — | — | — |
| B2 | 5.444256 | 5.364829 | — | — | — | — |
| C1 | 5.317147 | 5.224534 | — | — | — | — |
| C2 | 5.504749 | 5.425071 | — | — | — | — |
| D1 | 3.963567 | 4.042494 | 5.381139 | 3.342394 | 3.028308 | 2.945944 |
| D2 | 4.152480 | 4.231283 | 4.320147 | 3.554243 | 3.408386 | 3.133483 |
| M | 1.115735 | 1.038057 | — | — | — | — |
| N | 1.361579 | 1.271528 | 1.178415 | 2.492125 | 2.427821 | 2.366891 |
| R | 1.052993 | 0.975253 | — | — | — | — |

What is claimed is:

1. A die cast compressor housing for a compressor impeller comprising:

an outer shell including a partial outer circumferencial volute wall portion and a projection proximate a circumference of a central aperture in the shell, said central aperture concentric with an axis of rotation for the compressor impeller;

an insert having a first portion with a substantially cylindrical outer wall received in the aperture in the outer shell and including an air inlet, and said insert further having a second portion extending from the first portion radially outwardly with respect to the axis and including a mating projection for engagement with the outer shell projection to form an inner circumferencial volute wall portion; and a backplate having a third projection proximate an outer circumferencial portion, the third projection received in a relief in the outer shell and completing the outer circumferencial volute wall portion;

said outer shell projection having a first land engaging a second land on the mating projection, the first and second lands spirally descending relative to a datum plane, said datum plane perpendicular to the axis; and, said relief having a third land in spaced relation to a fourth land on the third projection, the third and fourth lands spirally descending relative to the datum.

2. A die cast compressor housing as defined in claim 1 wherein the second portion of the insert further includes an outer wall for a diffuser and the backplate incorporates a portion radially inward from the third projection having an inner wall for the diffuser.

3. A die cast compressor housing as defined in claim 1 wherein the second portion of the insert further includes an inner volute wall portion.

4. A die cast compressor housing, for a compressor impeller comprising:

an outer shell including a partial outer circumferncial volute wall portion and a projection proximate a circumference of a central aperture in the shell, said central aperture concentric with an axis of rotation for the compressor impeller;

an insert having a first portion with a substantially cylindrical outer wall received in the aperture in the outer shell and including an air inlet, and said insert further having a second portion extending from the first portion radially outwardly with respect to the axis and including a mating projection for engagement with the outer shell projection to form an inner circumferencial volute wall portion; and a backplate having a third projection proximate an outer circumferencial portion, the third projection received in a relief in the outer shell and completing the outer circumferencial volute wall portion;

said outer shell projection having a first land engaging a second land on the mating projection, the first and second lands spirally descending relative to a datum plane, said datum plane perpendicular to the axis; and, said relief having a third land in spaced relation to a fourth land on the third projection, the third and fourth lands spirally descending relative to the datum, wherein the first and second lands descend from the datum in 15 degree sectors with a normalized dimension profile as follows:

2.3058367, 2.2487189, 2.1971003, 2.1489188, 2.1019247, 2.0561804, 2.0122484, 1.9701912, 1.9282589, 1.8844519, 1.8373953, 1.7874015, 1.735908, 1.683789, 1.630921, 1.575178. 1.513685, 1.442944, 1.361579, 1.271528. 1.178415, 2.492125, 2.427821, 2.366891; and the fourth land descends from the datum in corresponding 15 degree sectors with a normalized dimensional profile as follows:

1.9716285, 1.9635045, 1.9262592, 1.8775153, 1.8310211. 1.7885889, 1.7462192, 1.6994750, 1.6482939, 1.5946131 , 1.5411823, 1.4887514, 1.436695, 1.383139, 1.325771, 1.263154, 1.195663, 1.125359, 1.052993. 0.975253; and the third land descends in spaced relation to the fourth land.

* * * * *